United States Patent [19]

Sukumoda et al.

[11] Patent Number: 5,052,476

[45] Date of Patent: Oct. 1, 1991

[54] HEAT TRANSFER TUBES AND METHOD FOR MANUFACTURING

[75] Inventors: Shunroku Sukumoda; Seizo Masukawa; Haruo Kohno, all of Aizuwakamatsu, Japan

[73] Assignee: 501 Mitsubishi Shindoh Co., Ltd., Fukushima, Japan

[21] Appl. No.: 574,490

[22] Filed: Aug. 28, 1990

[30] Foreign Application Priority Data

Feb. 13, 1990 [JP] Japan ..... 2-31762
Feb. 13, 1990 [JP] Japan ..... 2-31763

[51] Int. Cl.[5] ..... F28F 1/40

[52] U.S. Cl. ..... 165/133; 165/179; 165/183; 165/184; 138/38

[58] Field of Search ..... 165/133, 179, 181, 183, 165/184; 138/38

[56] References Cited

U.S. PATENT DOCUMENTS

| | | | |
|---|---|---|---|
| 3,885,622 | 5/1975 | McLain | 165/179 |
| 4,004,441 | 1/1977 | Leszak | 165/133 |
| 4,166,498 | 9/1979 | Fujie et al. | 165/133 |
| 4,216,826 | 8/1980 | Fujikake | 165/133 |
| 4,458,748 | 7/1984 | Yamada et al. | 165/133 |
| 4,733,698 | 3/1988 | Sato | 165/179 |

FOREIGN PATENT DOCUMENTS

| | | | |
|---|---|---|---|
| 113996 | 9/1981 | Japan | 165/133 |
| 77890 | 5/1982 | Japan | 165/133 |
| 150799 | 9/1982 | Japan | 165/133 |

*Primary Examiner*—John Rivell
*Assistant Examiner*—L. R. Leo
*Attorney, Agent, or Firm*—Kane Dalsimer Sullivan Kurucz Levy Eisele and Richard

[57] ABSTRACT

A heat transfer tube having an inner surface in which are formed primary grooves and secondary grooves. The primary grooves parallel to one another, extending at an angle to the longitudinal direction of the heat transfer tube and secondary grooves parallel to one another, extending an angle to the primary grooves. At the intersections of the primary and secondary grooves is formed a series of pear-shaped grooves whose inner opening dimension is smaller than the dimension of the bottom of the pear-shaped groove.

7 Claims, 10 Drawing Sheets

(A—A)

(B—B)

(C—C)

(D—D)

FIG.16 (PLAIN TUBE)
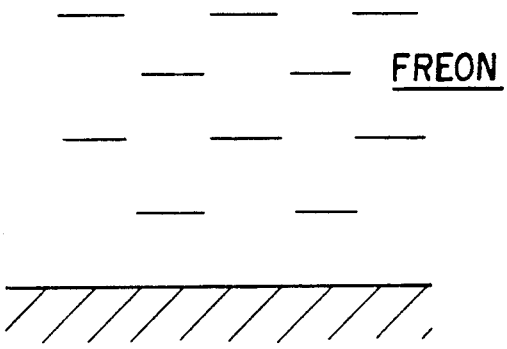
FIG.17 (SINGLE GROOVED TUBE)
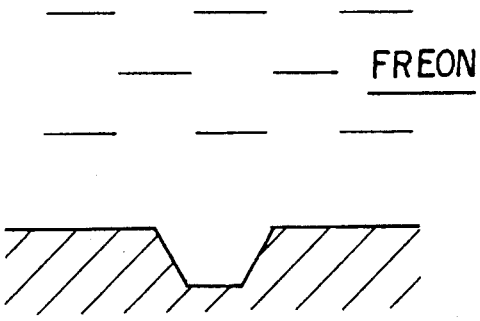
FIG.18 (THIS INVENTION)
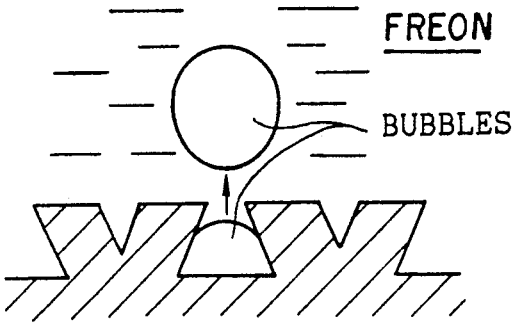

FIG.20 (mm)
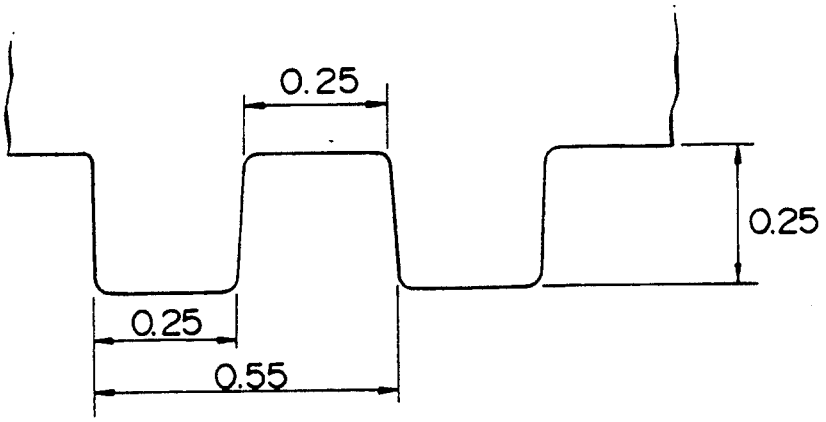
FIG.21 (mm)
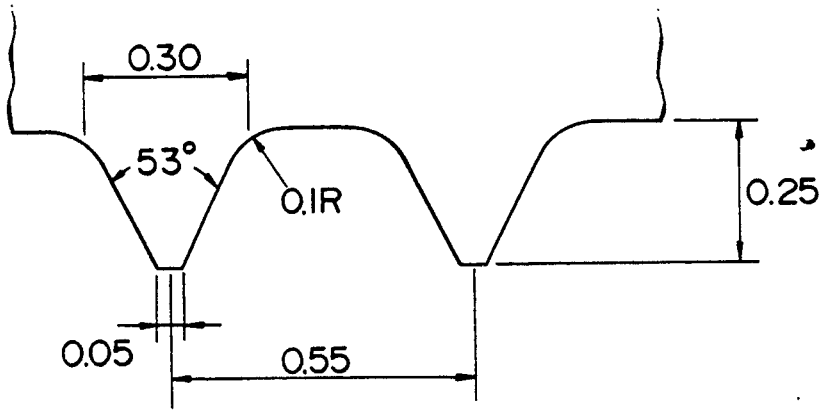

HEAT TRANSFER TUBES AND METHOD FOR MANUFACTURING

BACKGROUND OF THE INVENTION

1. Field of the Invention

The present invention relates to heat transfer tubes which are utilized as vaporization and condensation tubes in apparatus such as heat exchangers and heat pipes.

2. Background Art

Heat transfer tubes made of metals, such as copper, having many straight or helical grooves on the inner surfaces, which can be manufactured by roll-forming or drawing processes, have been known in the past.

These grooves provide the following benefits;

1. When used as condensation tubes, these heat transfer tubes produce improved liquefaction efficiency by increasing the turbulence of the vapors as well as improved nucleation of the liquid phase brought about by the action of the surface irregularities. Furthermore, the surface tension effects on the liquid in the grooves serve to retain the fluid and promote good drainage, leading to increased reflux efficiency.
2. When these tubes are used in vaporizers, the edges of the grooves act as nucleation sites for the bubbles to provide rapid boiling, thus increasing the efficiency of liquid to vapor conversion. Furthermore, the surface tension effects serve to distribute the vaporizing liquid evenly throughout the vaporizer, promoting efficient conversion.

To improve the performance of such heat transfer tubes, it is advisable to decrease the width of the inner edges of the groove, making its profile resemble a trapezoid. Such a trapezoidal or pear-shaped grooves will promote nucleation of bubbles on the interior of the groove, which would act as nuclei for the formation of vapors, thus leading to a more efficient boiling and vaporization process. Also, the surface tension forces within the groove can be utilized more effectively to improve the liquid transport efficiency, leading to an overall gain in the heat transfer efficiency.

However, the conventional mechanical processes of manufacturing single grooved heat transfer tubes can only produce groove profiles whose opening is wider than that of the bottom or the outside edge. It has not been possible to manufacture tubes whose profile is pear-shaped, when viewed in the direction of the tube axis, and consequently, there was a limitation in improving the heat transfer performance of heat transfer apparatus such as heat exchangers.

SUMMARY OF THE INVENTION

The present invention relates to heat transfer tubes with improved heat transfer characteristics by overcoming the deficiencies present in the conventional heat exchanger tubes. The heat transfer tubes disclosed in this invention feature two types of intersecting grooves extending in two directions; numerous primary grooves which are extending in the axial direction, and which are intersected by parallel secondary grooves extending at an angle to the primary grooves. At the intersection points between the primary and secondary grooves are formed a series of pear-shaped grooves whose profile is trapezoidal, when viewed in the direction of the tube axis, that is, the dimension of the inner opening of the groove is smaller than that of the bottom of the groove.

The heat transfer tubes according to the present invention contain many periodic distributions of such pear-shaped grooves, therefore when these tubes are used in vaporizers, they promote efficient vaporization by providing readily available bubble nucleation sites to the evaporant liquid.

Furthermore, the heat transfer tubes according to the present invention rapidly dispose of the condensate liquid along the primary grooves because of the surface tension effects present within the grooves. Therefore, they provide improved transport efficiency compared with the conventional heat transfer tubes.

Furthermore, because of the method of forming these grooves, the interior surface area of the tubes is larger than that of the conventional tubes, in addition, the surface activity of these tubes are higher than the conventional tubes, because the edges of the protrusions are ragged and sharp owing to the method of manufacturing the grooves. Therefore, when the present tubes are used as condensation tubes, the liquefaction efficiency is increased because of the increased tendency of the vapor to condense at these surface active ragged edges of the grooves.

With respect to the method of manufacturing the heat transfer tubes according to the present invention, the feature of the invention comprises roll-forming a set of primary grooves on a strip of a given width in the length-wise direction; followed by roll-forming of the secondary grooves which intersect the primary grooves at a given angle, during which process, the pear-shaped grooves are formed at the intersections of the two types of grooves; followed by seam welding of the strip into tubes, with the grooved-surface on the inside.

By the use of the procedure described in this invention, it is possible to manufacture high performance heat transfer tubes which had been difficult to manufacture prior to this time. Furthermore, combining the two manufacturing processes of roll-forming and seam welding into an in-line production permits efficient mass production of such heat transfer tubes.

BRIEF DESCRIPTION OF THE DRAWINGS

FIGS. 16 to 18 are sketches to show the effects of surface irregularities on the nucleation of bubbles.

FIGS. 20 and 21 are the cross sectional drawings of the primary and secondary rolls for forming the primary and secondary grooves used in manufacturing the preferred embodiment of the present invention.

DETAILED DESCRIPTION OF THE PREFERRED EMBODIMENTS

The preferred embodiments of the present invention are explained with reference to FIGS. 1 to 15, inclusively.

Figure 1:
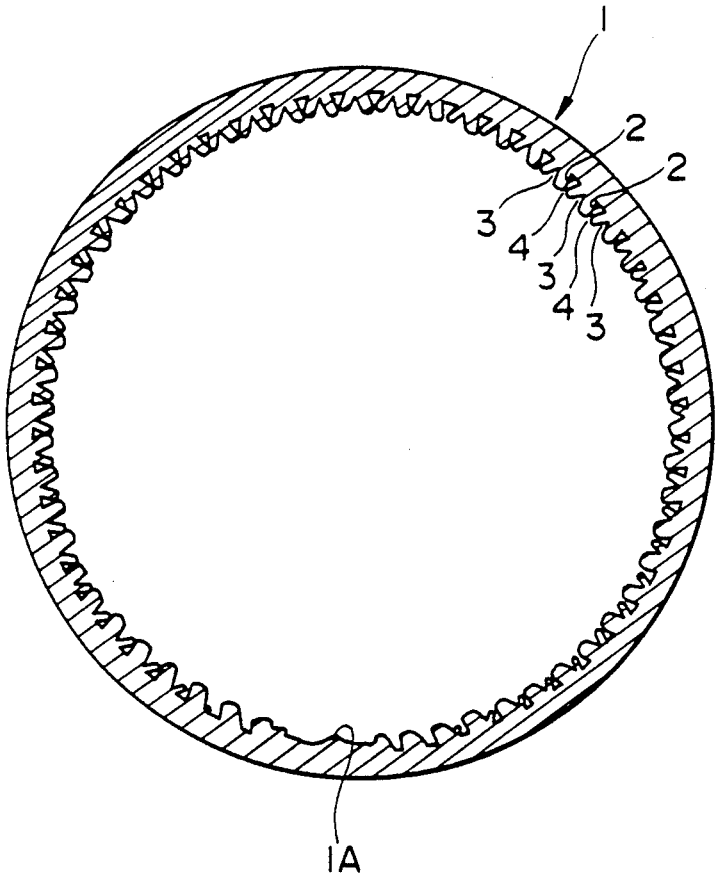
FIG. 1 is a cross sectional appearance of the preferred embodiment of the present invention.
Figure 2:
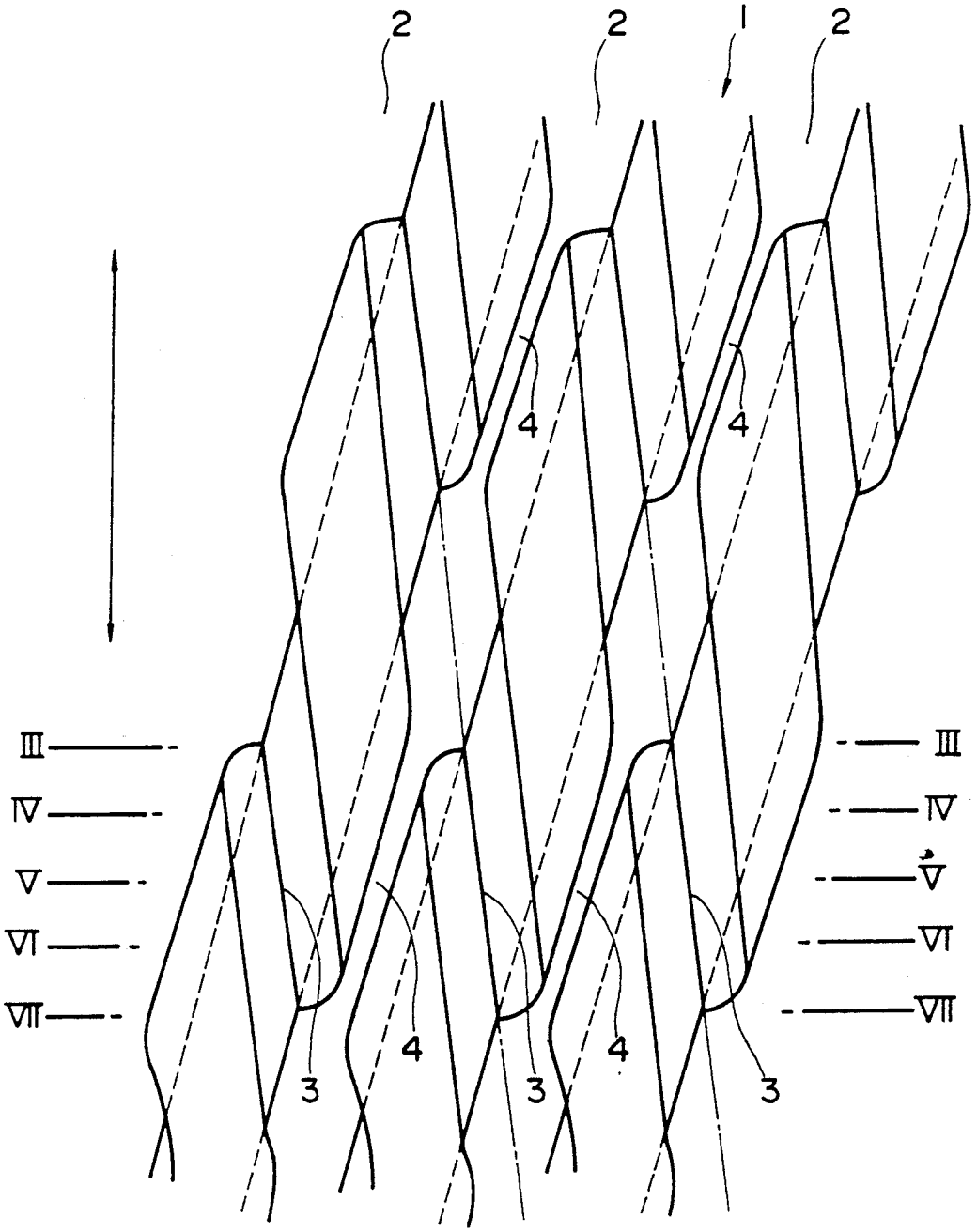
FIG. 2 is an enlarged schematic drawing of the two types of intersecting grooves on the interior of the heat transfer tube.
Figure 3:
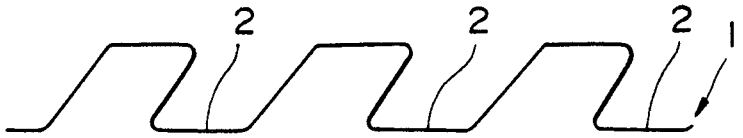
FIG. 3 to FIG. 7 are the cross sectional sketches of the various sections, including those of the tubular cavity, of the grooves shown in FIG. 2 at successive sections starting from III—III and ending at VII—VII, respectively.
Figure 4:
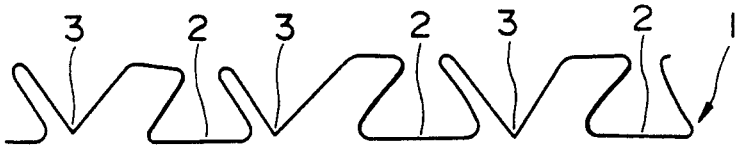
Figure 5:
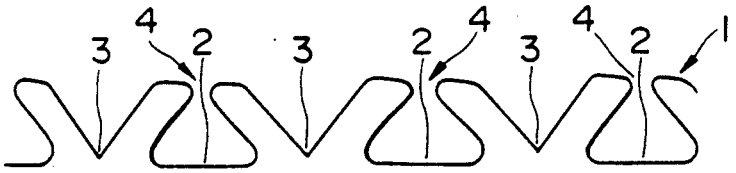
Figure 6:
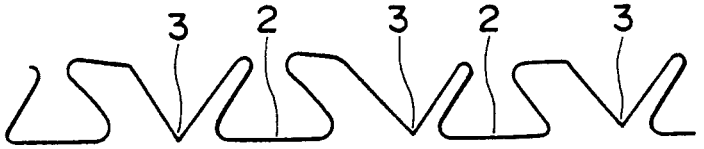
Figure 7:
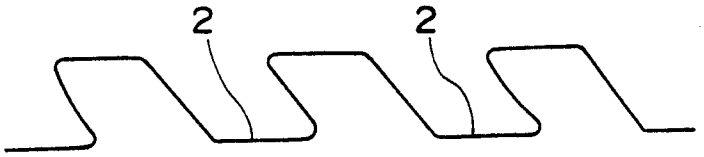

The preferred embodiments shown in FIGS. 1 and 2 have heat transfer tube 1, whose inner surface contain parallel primary grooves 2 extending at an angle to the tube axis, and the parallel secondary grooves 3, extending at an angle to the primary grooves. The sidewalls of the primary grooves 2 are bent towards each other at the intersection points of the primary grooves 2 with the secondary grooves 3, resulting in the narrowing of the opening of the grooves 2 and the forming of pear-shaped grooves 4. On a section of the interior of the metal tube 1, there exist a band of welded section 1A, which extends in the direction of the tube axis.

The metal tube 1 is made of conventional materials such as copper, copper alloys and aluminum, with the choice of wall thickness and diameter being left to individual requirements.

Figure 11:
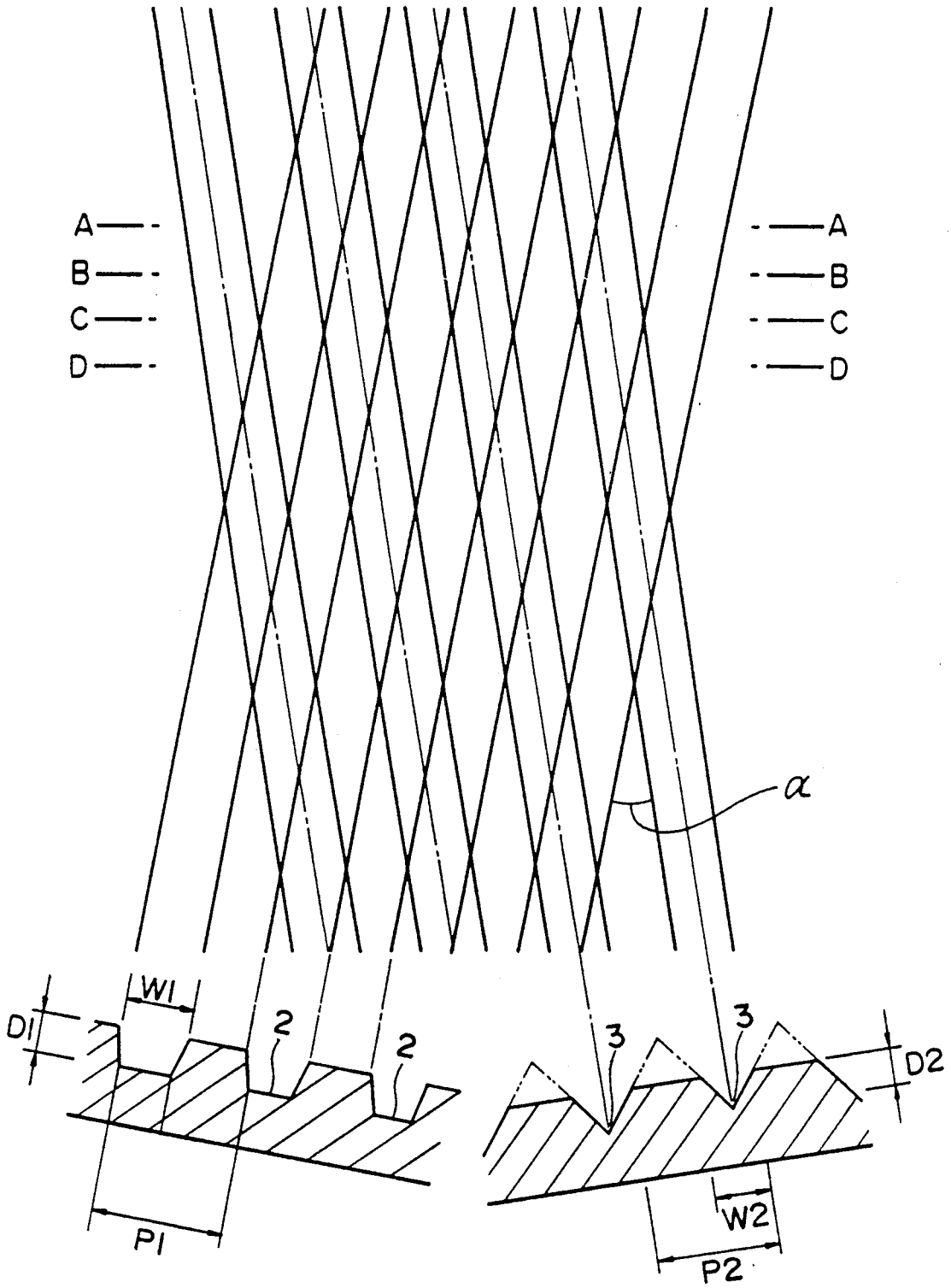
FIGS. 11 to 15 are sketches of the profile changes which take place during secondary roll-forming to aid in explaining the manufacturing processes.
Figure 12:
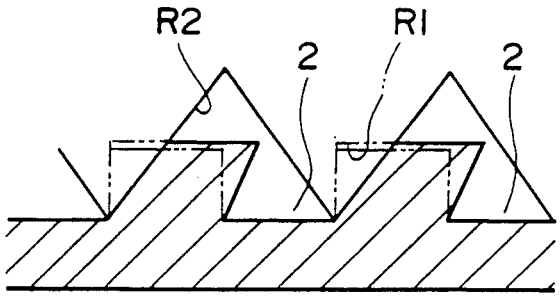
Figure 13:
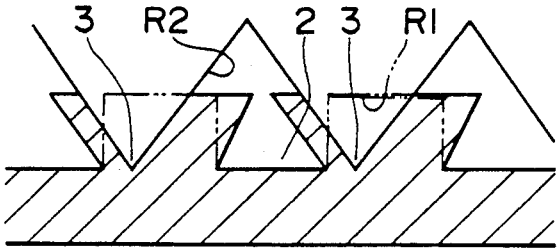
Figure 14:
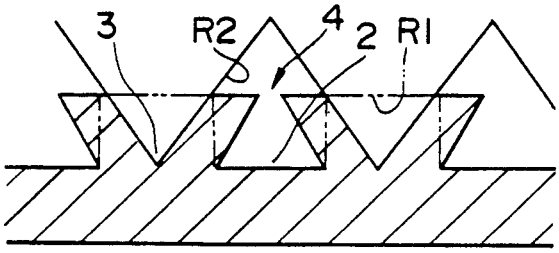
Figure 15:
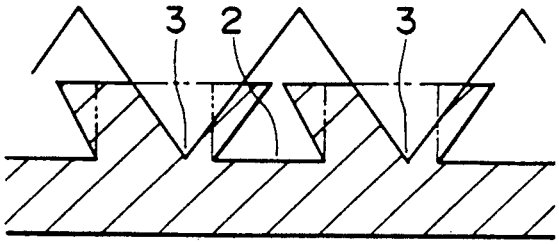
Figure 19:
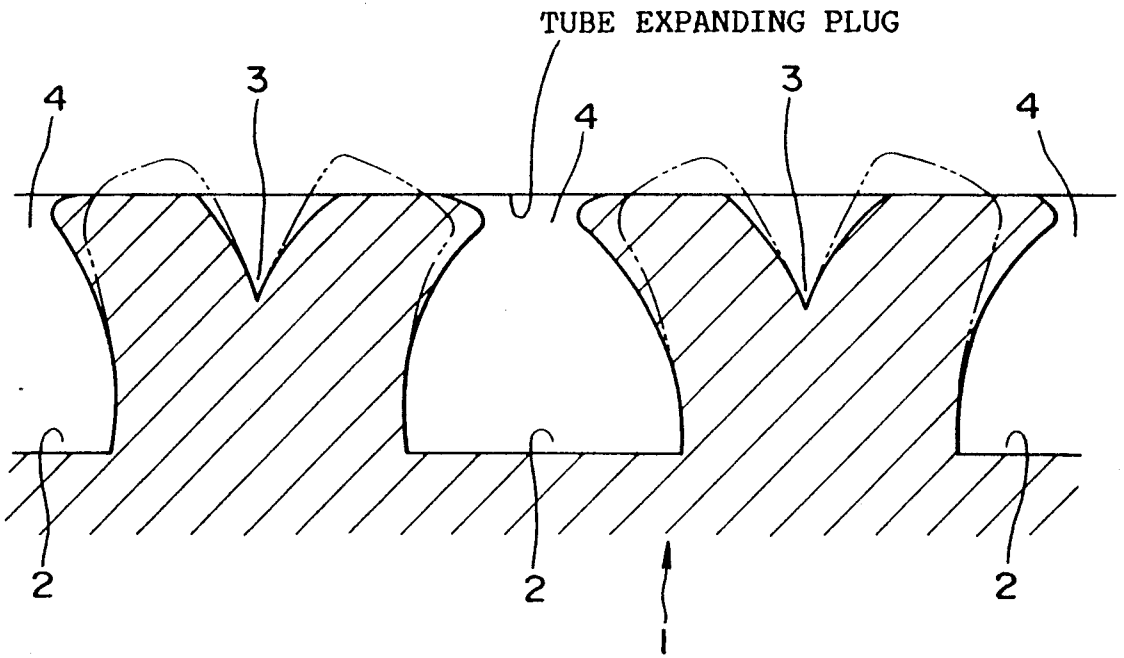
FIG. 19 is an expanded view of the cross section of the grooves in the present embodiment.
Figure 22:
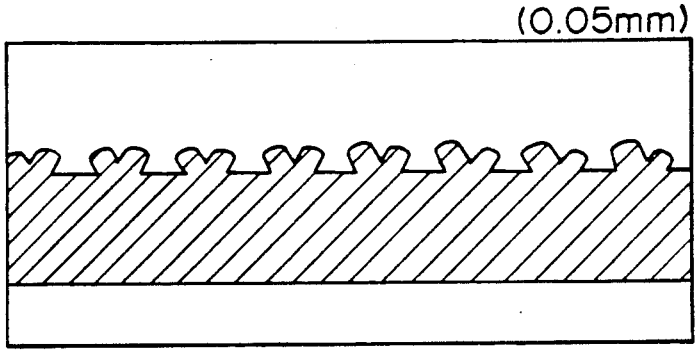
FIGS. 22 to 25 are enlarged views of the cross section of experimental tubes.
Figure 23:
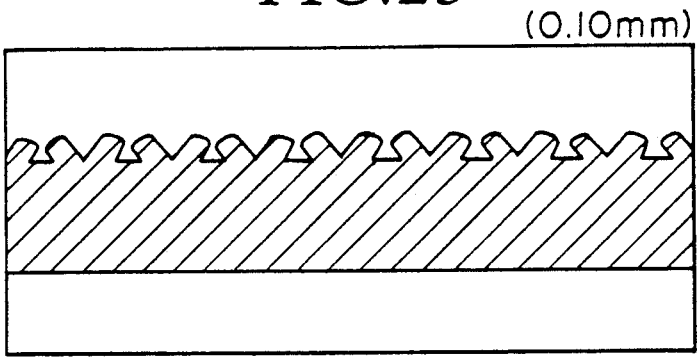
Figure 24:
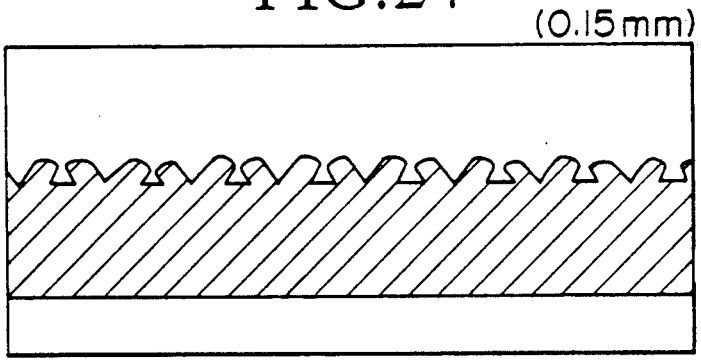
Figure 25:
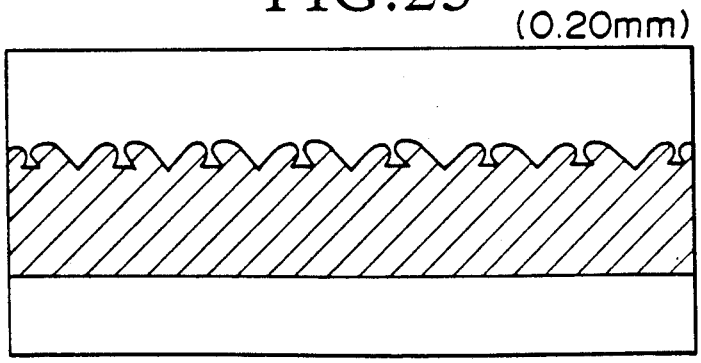

The primary grooves 2 are formed first, by using the primary roll R1 whose cross section is similar to the sketch shown in FIG. 11, in which the bottom angle is close to right angles. Still in reference to FIG. 11, such a U-shaped profile is readily amenable to bending at the upper section of the groove to form the correct profile of the pear-shaped grooves.

The dimension of the opening width of the primary groove W1 is equal to 40–140%, preferably in the range of 80–120% of the groove depth D1. If this dimension is less than 40%, the primary grooves 2 become susceptible to collapsing in the process of forming the secondary grooves 3. If this ratio is greater than 140%, it becomes difficult to close the opening of the primary grooves 2.

The spacing P1 of the primary groove 2 is 1.5–3 times, preferably 1.8–2.2 times the dimension of the opening width of the groove 2. If the ratio is less than 1.5, it is difficult to form the tubular cavity 4 because of the tendency of the walls of the primary grooves 2 to flatten during the manufacturing of secondary grooves 3.

If the ratio is greater than 3, the density of spacings of the primary grooves becomes insufficient, leading to a loss of performance of the thermal transfer characteristics.

In practice, heat transfer tubes for common purposes will have a range of preferred dimensions of D1=0.2–0.3 mm, width W1=0.2–0.5 mm, P1=0.4–1.5 mm and the angle at the bottom edge of the groove of over 75°.

With regard to the secondary grooves 3, the cross sectional profile is a "V" shape, The spacing P2 of the secondary grooves 3 can be the same as or different from that of the primary grooves 2. The width W2 of the secondary grooves 3 is 25–90% of the groove opening W1 of the primary grooves 2, preferably in the range of 50–70%. If the ratio is less than 25%, it is not possible to close the dimension W1 of the opening of the primary grooves 2. If this ratio is greater than 90%, there is a danger of closing off the opening of the primary groove 2.

With regard to the depth D2 of the secondary grooves 3, it is in the range of 50–100%, preferably in the range of 80 to 100% of the dimension of the D1 of the primary groove 2. If it is less than 50%, it is not possible to close the opening of the primary groove 2 while if it is greater than 100%, there is a danger of closing off the opening of the primary groove 2.

In practice, for heat transfer tubes in common usage, the depth D2=0.15–0.3 mm, the spacing P2=0.4–1.5 mm, the angle at the bottom of the "V" shaped secondary groove should be in the range of 45°–90°.

The angle alpha of intersection between the primary and the secondary grooves is in the range of 20°–60°, preferably in the range of 30°–40°. If it is beyond the range of 20°–60°, it becomes difficult to form optimum shape of pear-shaped grooves 4. Also, it is desirable that the primary grooves 2 be oriented less than 30° from the longitudinal direction of the tube. Larger deviation angles cause poor drainage of the condensate in the longitudinal direction of the metal tube 1.

By making the two types of grooves, the primary groove 2 and the secondary grooves 3, as described above, the opening width of the pear-shaped grooves 4 becomes less than 75% of the width W1 of the primary grooves 2. When the opening width becomes larger than this value, the beneficial effects of bubble formation decrease, lessening the relative improvements in the thermal transfer performance of the present embodiment, compared with the conventionally prepared heat transfer tubes.

Figure 8:
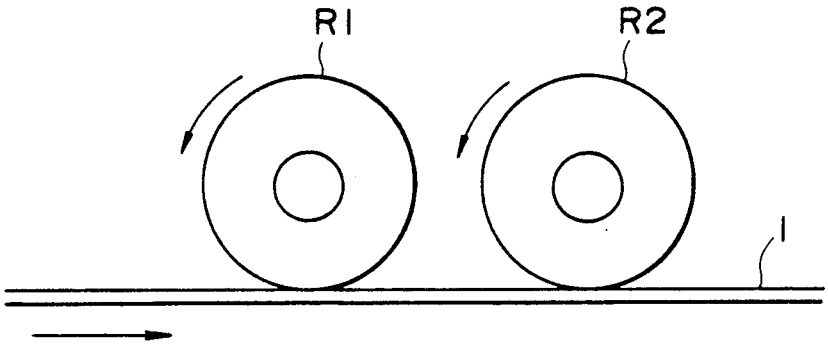
FIG. 8 is a sketch to illustrate in-line roll-forming of the grooves to manufacture heat transfer tubes.

Next, the manufacturing methods of the present invention are described. First, strip materials 1 are roll-formed continuously by means of the primary roll R1 and the secondary roll R2 produce primary grooves 2 and secondary grooves 3, as illustrated in FIG. 8.

Figure 9:
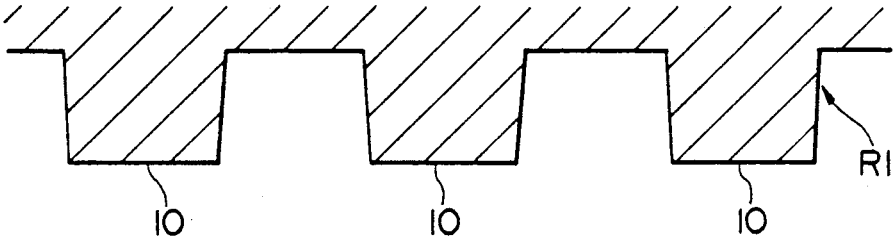
FIG. 9 is a sketch to show the cross section of a roll for forming the primary grooves.

On the exterior surface of the roll R1 are present many parallel protruding sections 10, of a profile shown in FIG. 9, oriented at an angle to the circumferential direction of the roll R1. These protruding sections 10 replicate their shape and direction on the surface of the long strip materials 1, thus forming the grooves which are termed primary grooves 2 in this invention. It is easier to produce preferred shape of pear-shaped grooves 4 on the strip materials 1 when the profile of the primary groove 2 has a shape as shown in FIG. 9, which shape is readily amenable to deformation by roll-forming.

Figure 10:
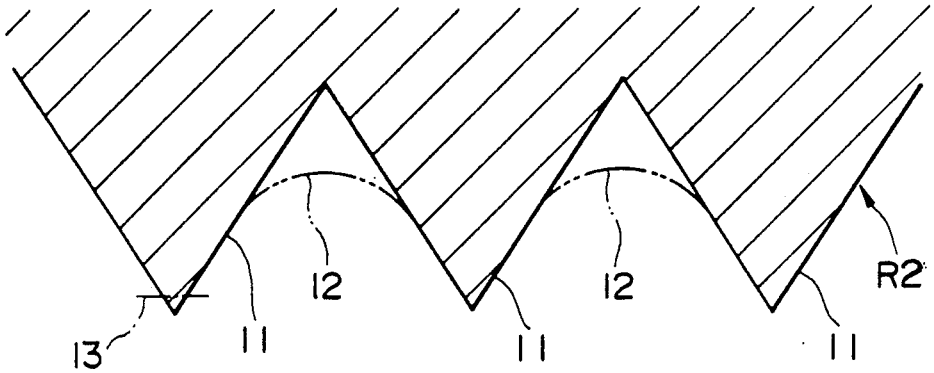
FIG. 10 is a sketch to show the cross section of a roll for forming the secondary grooves.

With regard to the secondary roll R2, the exterior surface of this roll has a series of parallel "V" shaped protrusions 11, as shown in FIG. 10. The lines of protrusions are made in the radial direction of the roll R2, at an angle opposite to those lines of protruding sections 10 on the roll R1. This roll replicate "V" shaped depressions on the strip materials thus forming secondary grooves 3, which cross the primary grooves at an angle alpha, as shown in FIG. 11.

The shape of the protrusions 11 on the secondary roll R2 can be made round as shown by the dotted lines in FIG. 10. The round shape 12 is useful in the smooth operation of the secondary rolling to close up the side walls of the primary groove 2. Also, the tip of the protrusions 11 can be shaped as a narrow flat tip as shown by another dotted line 13.

Next, after the completion of the roll-forming operations to form primary and secondary grooves, the roll-formed strip material 1 is placed in an electric seam welder with the embossed surface facing the interior of the tube. After passing through a series of shaper rolls of progressively smaller diameters, the strip material 1 is made into a long tube by seam welding of the two longitudinal edges of the strip material 1. The equipment for seam welding can be any common types, and the usual welding conditions can be employed. The welded region can be further treated, as necessary, cleaned and the tube is wound on a spool or cut into desired lengths to be used as heat transfer tubes.

The heat transfer tubes, manufactured according to the descriptions provided in this invention, possess numerous evenly spaced pear-shaped grooves 4, spaced regularly along the primary grooves 2, whose opening width is narrower than the outside width of the cavity. When this type of tubes are used in the vaporizer section of a heat exchanger, the vaporization efficiency of a liquid media, for example Freon, is increased markedly, as a result of the ready tendency of bubble nucleation on the interior of the tubular cavity, as illustrated in FIG. 18, compared with the case of a smooth surfaced tubes illustrated in FIG. 16, or the case of simple grooves illustrated in FIG. 17.

Furthermore, because of the fact that these pear-shaped grooves 4 are located periodically along the primary grooves 2, the liquid condensate, aided by the capillary action, runs swiftly down along the primary grooves 2, thus providing improved transport efficiency compared with the case of single grooved tubes in the same heat exchanger.

Furthermore, by having two types of grooves, types 2 and 3, the interior surface area of the tube is increased compared with that of other similar single grooved tubes; additionally, the action of cross-rolling produces sharp edges on the edges of the pear-shaped grooves 4, leading to increased surface activity and the corresponding increase in condensation efficiency.

Furthermore, the manufacturing processes described heretofore, the roll-forming, shaping and seam welding operations can be performed as an in-line processes, thus enabling efficient mass production of the present embodiments at a low cost.

The preferred embodiments described in this invention described a case of a round cross sectional tube, but the applicability of this invention is not limited to such a shape alone but applies equally well to elliptical as well as flattened tube shapes.

Also, the preferred embodiment described in this invention related a case of a strip material of a width sufficient to produce a single tube, but the invention is also suitable to manufacturing multiple sections, for example, after forming the grooves 2 and 3 using wide rolls, said strip material is slit into a single tube width to manufacture a plurality of heat transfer tubes; in fact, such an arrangement would be more productive for producing the tubes according to the present embodiments.

If it is necessary to attach cooling fins to the tubes described in the present embodiment, this can be accomplished by press fitting the tubes through the holes in the fins by expanding the diameter of the tubes by means of a tube expander plug.

In the above case, the expanding ratio should be held to within 10% of the outer diameter of the tube, but more preferably to less than 7%. When the expanding ratio becomes greater than 10%, the increased compression of the inside surfaces results in a danger of a loss of beneficial effects produced by the pear-shaped grooves 4, as a result of the collapsing of the grooves caused by the plug expansion operation.

It is possible to utilize the tube expanding operation to improve the performance of the tube, by suitably adjusting the operational parameters to cause further narrowing of the opening of the secondary grooves 3, which introduces additional narrowing of the opening of the pear-shaped grooves 4 located along the primary grooves 2.

EXAMPLE

Using oxygen-free copper strip materials of 38 mm width by 0.5 mm thickness, experimental tubes were produced by subjecting them to primary and secondary roll-forming operations. The cross sectional shape was checked by sectioning. The trials were conducted by using four different widths of the opening of the secondary grooves as follows, 0.05, 0.1, 0.15 and 0.2 mm while maintaining the width of the primary grooves at 0.25 mm.

The dimensions, 120 mm diameter by 38 mm width, were the same for both the primary and secondary groove forming rolls. The shape of the protrusions on the primary roll is shown in FIG. 20 while that of the secondary rolls is shown in FIG. 21. All the dimensions are given in mm.

The cross sectional shapes of the various tubes obtained by varying the width of the secondary grooves are shown in FIGS. 22 to 25. As shown in these figures, all the tubes having the secondary groove width larger than 0.1 mm are quite satisfactory.

What is claimed is:

1. A heat transfer tube having an inner surface in which are formed:

(a) primary grooves, having a U-shaped cross section and parallel to one another, extending at an angle to the longitudinal direction of the heat transfer tube, (b) secondary grooves, having a V-shaped cross section and parallel to one another, extending at an angle and intersecting with the primary grooves, and (c) pear-shaped grooves, having an opening width formed between the intersections of the primary and secondary grooves, having a trapezoidal cross sectional shape, said opening width being smaller than the dimension of their bottom portion, and are distributed regularly and uniformly along the primary grooves.

2. A heat transfer tube according to claim 1 wherein the widths of the opening of the pear-shaped grooves are not wider than about 75% of the widths of the opening of the primary grooves.

3. A heat transfer tube according to claim 2 wherein the widths of the opening of the primary grooves are between about 40% to 140%, inclusive, of the depth of the primary grooves.

4. A heat transfer tube according to claim 2 wherein the primary grooves are equidistantly spaced at a distance about 1.5 to 3 times the width of the opening of the primary grooves.

5. A heat transfer tube according to claim 2 wherein the widths of the opening of the secondary grooves are between about 25% to 90%, inclusive, of the width of the opening of the primary grooves.

6. A heat transfer tube according to claim 2 in which the depth of the secondary grooves are between about 50% to 100%, inclusive, of the depth of the primary grooves.

7. A heat transfer tube according to claim 1 wherein a tube is made of a material selected from the group consisting of copper, copper alloys, aluminum and aluminum alloys.

* * * * *